US011147364B2

(12) United States Patent
Liu

(10) Patent No.: US 11,147,364 B2
(45) Date of Patent: Oct. 19, 2021

(54) BRUSH HEAD FOR A PERSONAL GROOMING DEVICE

(71) Applicant: JS Holding Inc., Dover, DE (US)

(72) Inventor: Xinlan Liu, Rowland Heights, CA (US)

(73) Assignee: JS Holding Inc., Dover, DE (US)

( * ) Notice: Subject to any disclaimer, the term of this patent is extended or adjusted under 35 U.S.C. 154(b) by 0 days.

(21) Appl. No.: 16/740,796

(22) Filed: Jan. 13, 2020

(65) Prior Publication Data

US 2020/0229584 A1 Jul. 23, 2020

Related U.S. Application Data

(63) Continuation of application No. 16/254,719, filed on Jan. 23, 2019, now Pat. No. 10,531,729.

(51) Int. Cl.

| | |
|---|---|
| ***A46B 5/00*** | (2006.01) |
| ***A46B 7/04*** | (2006.01) |
| ***A46B 13/02*** | (2006.01) |
| ***A46B 5/02*** | (2006.01) |
| ***A46B 13/00*** | (2006.01) |
| ***A46B 9/02*** | (2006.01) |

(52) U.S. Cl.

CPC ..... *A46B 13/02* (2013.01); *A46B 5/0095* (2013.01); *A46B 5/02* (2013.01); *A46B 7/042* (2013.01); *A46B 9/02* (2013.01); *A46B 13/008* (2013.01); *A46B 2200/1006* (2013.01)

(58) Field of Classification Search

CPC ..... A46B 5/0095; A46B 7/042; A46B 13/02; A46B 13/008; A46B 2200/1006

See application file for complete search history.

(56) References Cited

U.S. PATENT DOCUMENTS

| | | | | |
|---|---|---|---|---|
| 6,032,313 | A | 3/2000 | Tsang | |
| 7,320,691 | B2 | 1/2008 | Pilcher et al. | |
| 7,386,906 | B2 | 6/2008 | Roth et al. | |
| 10,182,642 | B2 | 1/2019 | Khormaei | |
| 2019/0290410 | A1* | 9/2019 | Bloch | A61C 17/349 |

* cited by examiner

*Primary Examiner* — Randall E Chin
(74) *Attorney, Agent, or Firm* — Fox Rothschild LLP

(57) ABSTRACT

A removable brush head for a personal groom device, the removable brush head having a stationary portion, wherein the stationary portion is annular and includes a plurality of outwardly-extending brush bristles. The removable brush head also includes a movable portion positioned within the stationary portion, wherein the movable portion is configured to at least partially rotate relative to the stationary portion, and further wherein the movable portion includes a plurality of outwardly-extending brush bristles. Additionally, the removable brush head includes a locking collar, wherein the locking collar is slidably couplable to the stationary portion so as to axially retain the movable portion within the stationary portion while allowing the movable portion to at least partially rotate relative to the stationary portion.

19 Claims, 8 Drawing Sheets

BRUSH HEAD FOR A PERSONAL GROOMING DEVICE

RELATED APPLICATIONS AND CLAIM OF PRIORITY

This patent document is a continuation of, and claims priority to, U.S. patent application Ser. No. 16/254,719 filed Jan. 23, 2019, now U.S. Pat. No. 10,531,729 issued Jan. 14, 2020, the disclosure of which is fully incorporated into this document by reference.

BACKGROUND

This disclosure relates to the field of removable and replaceable brush heads and, more particularly, to a brush head attachable to a personal grooming device.

Personal grooming devices used for, e.g., skin cleansing have become increasingly common in recent years. Most of these personal grooming devices include a hand-held appliance housing one or more electric motors, with the electric motor(s) configured to rotate or oscillate at least a portion of an attached brush head so as to provide a cleansing action on the user's skin. Due to the need for frequent cleaning and/or replacement, the brush heads are configured to be removable from the hand-held appliance.

In some arrangements, the attached brush head includes two separate portions: a first, stationary portion having a plurality of bristles, and a second, movable portion, also having a plurality of bristles. In most configurations, the stationary portion annularly surrounds the movable portion, with the movable portion being couplable to a drive member of the hand-held appliance such that the movable portion may oscillate and/or rotate relative to the stationary portion. One example of such a brush head and hand-held appliance configuration is found in U.S. Pat. No. 7,386,906, which discloses a brush head having movable, central portion positioned within a stationary portion. The movable portion of the brush head disclosed by U.S. Pat. No. 7,386,906 includes a plurality of depending legs, with the depending legs being operably coupled to a driving hub of the hand-held appliance so as to impart oscillatory and/or rotary motion on the movable portion of the brush head. To hold the movable portion within the stationary portion while still allowing for this oscillatory and/or rotary motion, some of the depending legs also include locking snap elements which are configured to engage a surface of the stationary portion of the brush head. However, while this configuration may axially retain the movable portion relative to the stationary portion under most conditions, the reliance upon only the locking snap elements of select depending legs to axially hold the movable portion within the stationary portion may cause to the movable portion to become dislodged from the surrounding stationary portion in the event that the depending legs are misaligned with the driving hub and/or if sufficient axial force is applied to the brush head during installation on the hand-held appliance.

This patent document describes an apparatus that may address at least some of the issues described above and/or other issues.

SUMMARY

In accordance with an aspect of the disclosure, a removable brush head for a personal groom device is disclosed. The removable brush head may include a stationary portion, wherein the stationary portion is annular and includes a plurality of outwardly-extending brush bristles. The removable brush head may also include a movable portion positioned within the stationary portion. The movable portion may be configured to at least partially rotate relative to the stationary portion, and the movable portion includes a plurality of outwardly-extending brush bristles. Additionally, the removable brush head may include a locking collar. The locking collar may be slidably couplable to the stationary portion so as to axially retain the movable portion within the stationary portion while allowing the movable portion to at least partially rotate relative to the stationary portion.

According to another aspect of the disclosure, a personal grooming device is disclosed. The personal grooming device may include a hand-held appliance, and one or more electric motors housed within the hand-held appliance. The personal grooming device also may include a driven hub coupled to the one or more electric motors, wherein the one or more electric motors are configured to impart at least one of an oscillatory motion and a rotary motion on the driven hub. The personal grooming device may further include a removable brush head coupled to the hand held appliance. The removable brush head may include a stationary portion, wherein the stationary portion is annular and includes a plurality of outwardly-extending brush bristles. The removable brush head may also include a movable portion positioned within the stationary portion, wherein the movable portion is configured to at least partially rotate relative to the stationary portion, and further wherein the movable portion includes a plurality of outwardly-extending brush bristles. Additionally, the removable brush head may include a locking collar, wherein the locking collar is slidably couplable to the stationary portion so as to axially retain the movable portion within the stationary portion while allowing the movable portion to at least partially rotate relative to the stationary portion. The movable portion of the removable brush head may be configured to be engageable with the driven hub such that the at least one of the oscillatory motion and the rotary motion of the driven hub is also imparted on the movable portion.

DETAILED DESCRIPTION

The following description is made for the purpose of illustrating the general principles of the present disclosure and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to". Additionally, use the term "couple", "coupled", or "coupled to" may imply that two or more elements may be directly connected or may be indirectly coupled through one or more intervening elements.

In this document, position-identifying terms such as "vertical", "horizontal", "front", "rear", "top", and "bottom" are not intended to limit the invention to a particular direction or orientation, but instead are only intended to denote relative positions, or positions corresponding to directions shown when a personal grooming device and/or brush head is oriented as shown in the Figures.

Figure 1:
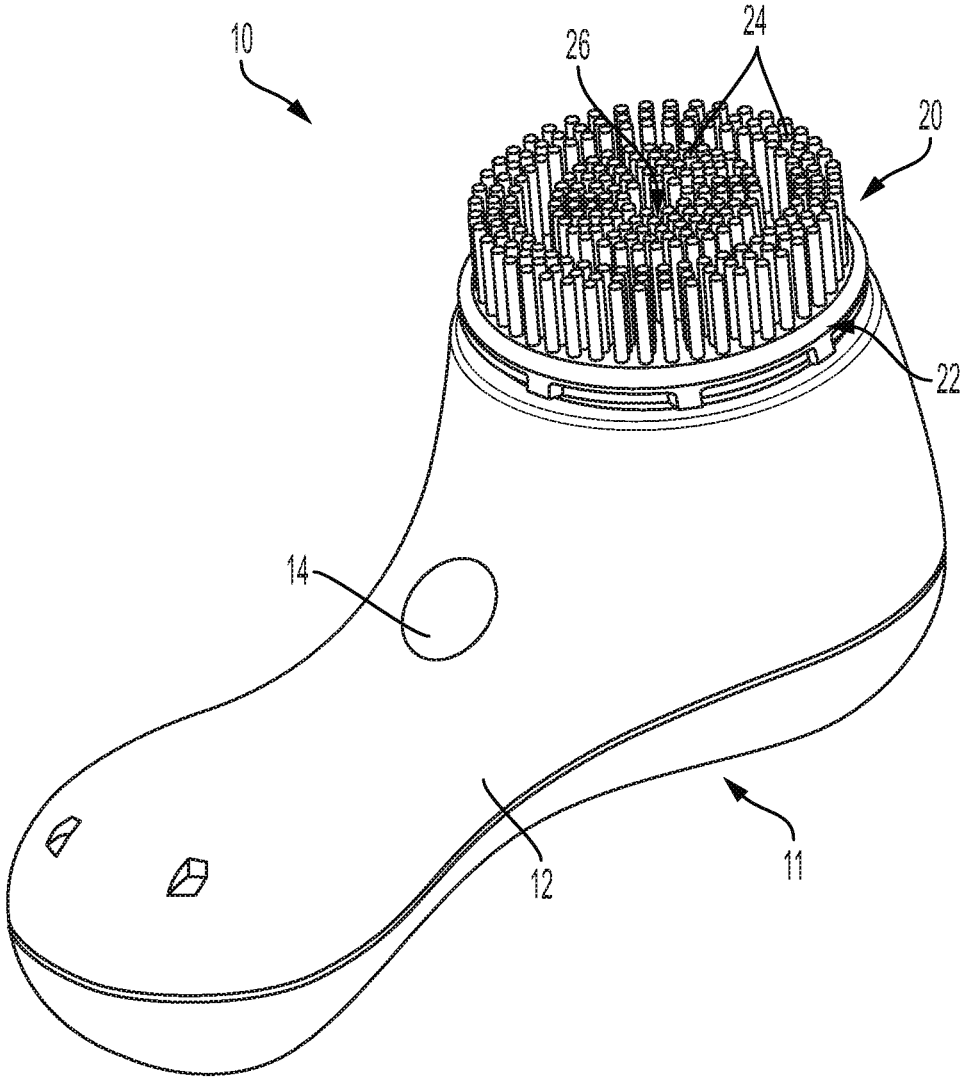
FIG. 1 is a perspective view of a personal grooming device having a removable brush head in accordance with an aspect of the disclosure.

Referring to FIG. 1, a personal grooming device 10 in accordance with an aspect of the disclosure is shown. Personal grooming device 10 includes a hand-held appliance 11 and a removable brush head 20. The hand-held appliance 11 includes an ergonomic handle portion 12, along with a power/mode button 14. While not shown in FIG. 1, it is to be understood that hand-held appliance 11 includes one or more electric motors housed therein, with the electric motor (s) being configured to impart oscillatory and/or rotary motion on at least a portion of the removable brush head 20 when the user depresses the power/mode button 14.

As shown in FIG. 1, removable brush head 20 includes a stationary portion 22 and a movable portion 26. As will be described in further detail herein, stationary portion 22 is configured to include at least one interface which allows for selective attachment and/or removal of the brush head 20 from the hand-held appliance 11. Both the stationary portion 22 and the movable portion 26 include a plurality of bristles 24, thereby allowing for cleaning/scrubbing action during use of the personal grooming device 10, even if only the movable portion 26 is oscillating and/or rotating during operation.

Figure 2:
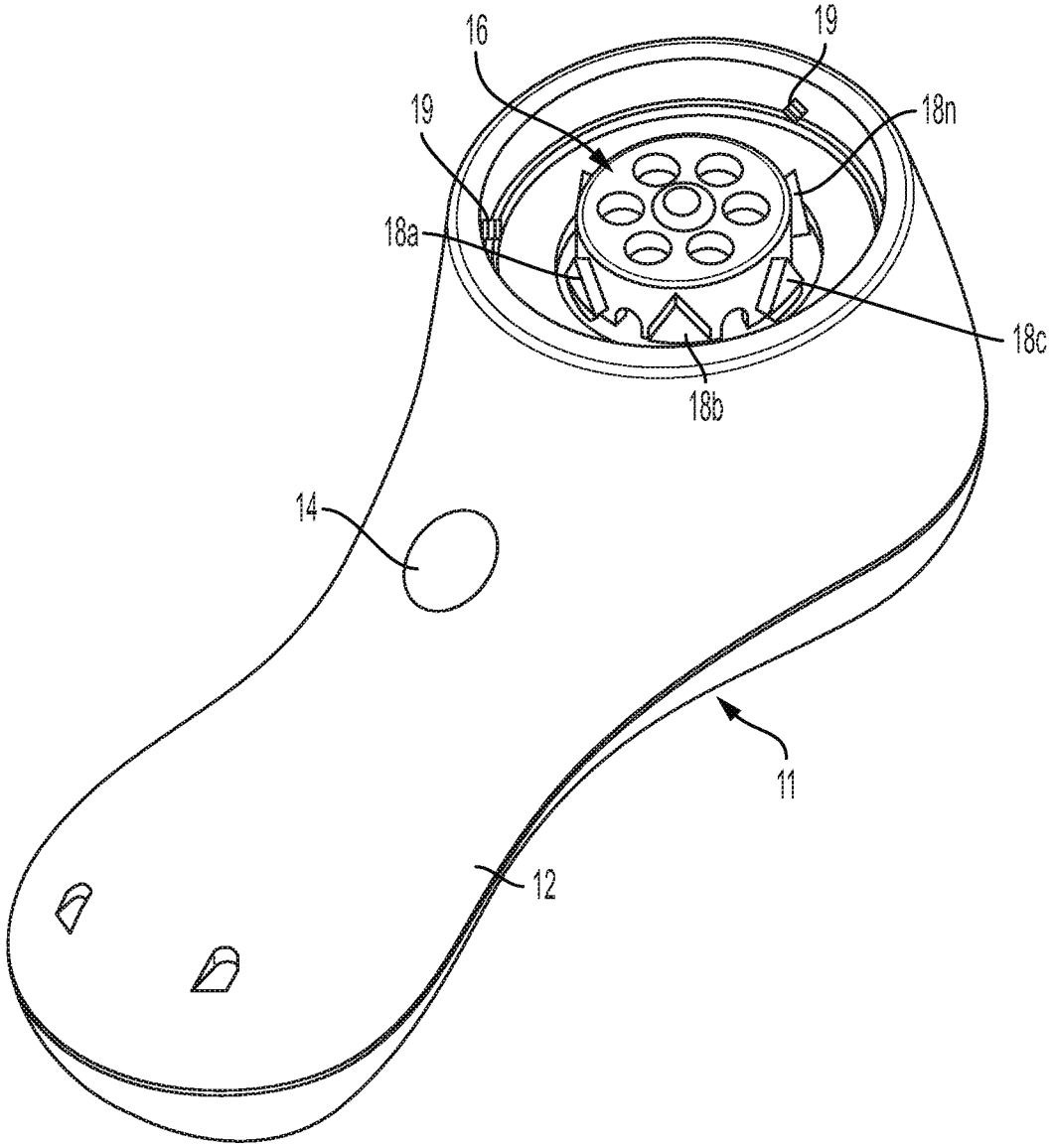
FIG. 2 is another perspective view of a hand-held appliance portion of the personal grooming device of FIG. 1.

Referring to FIG. 2, hand-held appliance 11 is shown in greater detail. Specifically, hand-held appliance 11 includes a drive hub 16, which is operably coupled to the one or more electric motors so as to impart oscillatory and/or rotary motion on the movable portion 26 of the removable brush head 20. Drive hub 16 includes any number of diamond-shaped projections 18*a* . . . 18*n* which, as will be described in further detail below, are spaced and shaped so as to operably engage the movable portion 26 of the removable brush head 20, thereby transferring the motion from the drive hub 16 to the movable portion 26. In the embodiment shown in FIG. 2, the projections 18*a*-18*n* are diamond-shaped, but other shapes are possible. Furthermore, hand-held appliance 11 includes a plurality of pins 19 extending from an annular surface surrounding the drive hub 16. The plurality of pins 19 are configured to engage slots formed within the stationary portion 22 of the removable brush head 20 so as to allow the removable brush head 20 to be selectively engaged/disengaged from the hand-held appliance 11 with a quarter-turn (or less) rotation. However, it is to be understood that the connection interface between hand-held appliance 11 and removable brush head 20 is not limited to the pin-and-slot interface described herein, and could be any appropriate interface such as, e.g., a threaded interface, a snap-fit interface, a press-fit interface, etc.

Figure 3:
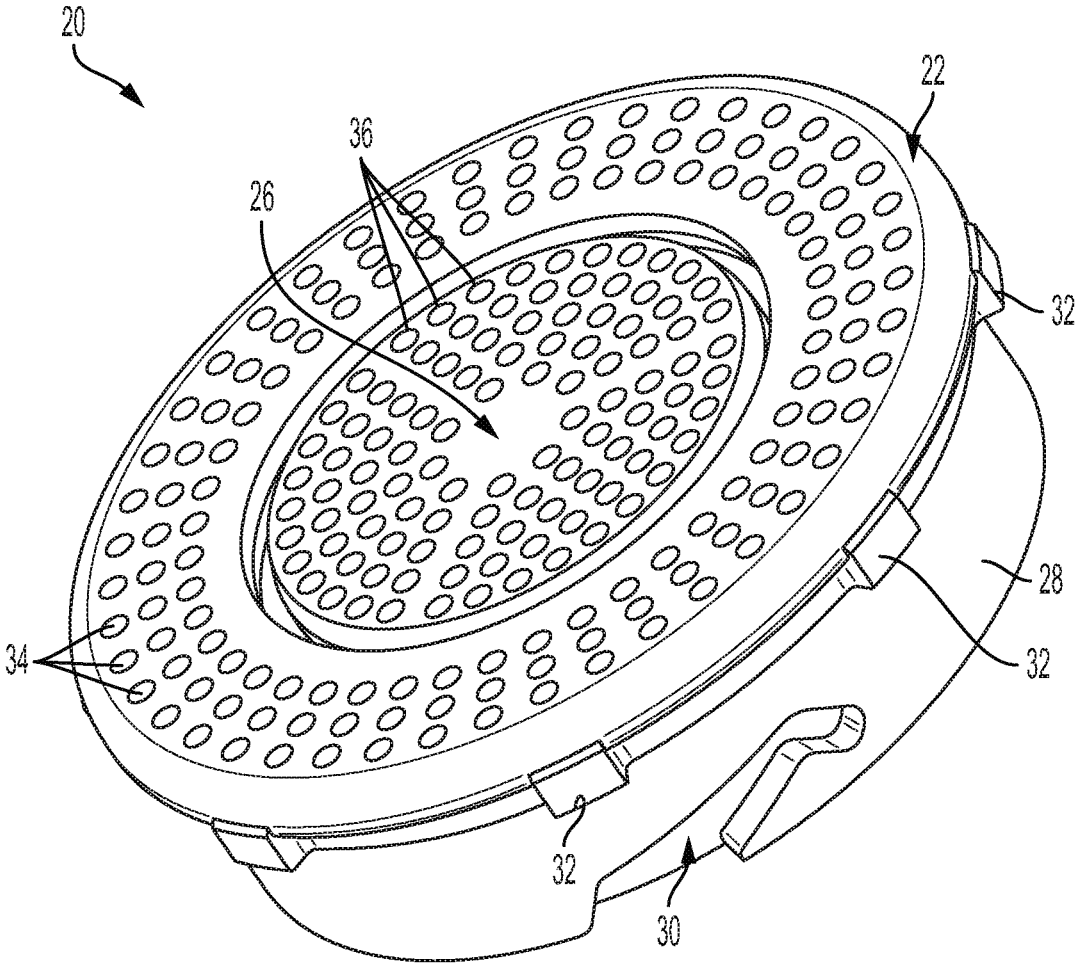
FIG. 3 is a top perspective view of the removable brush head of FIG. 1.

Next, referring to FIG. 3, removable brush head 20 in accordance with an aspect of the disclosure is shown in greater detail. Again, removable brush head 20 includes a stationary portion 22 surrounding a movable portion 26. Stationary portion 22 includes a rim 28 in which a plurality of slots 30 are formed. As described above with respect to FIG. 2, each of the plurality of slots 30 are sized and configured so as to receive a respective pin 19 extending from a surface of the hand-held appliance 11. The slots 30 are shaped so as to engage a respective pin 19 when the user rotates stationary portion 22 in a clockwise direction. Conversely, with counter-clockwise rotation, the stationary portion 22 may be released from the pins 19, thereby allowing the brush head 20 to be removed from the hand-held appliance 11. Alternatively, it is to be understood that the direction of rotation for engagement/disengagement of the removable brush head 20 from the hand-held appliance 11 may be reversed. While stationary portion 22 is shown as having three slots 30 (FIGS. 4A-4B), it is to be understood that more or fewer slots 30 (and pins 19) may be present. The stationary portion 22 may further include a plurality of grip protrusions 32, wherein the grip protrusions 32 are sized and spaced so as to provide a user with improved grip on the stationary portion 22 when rotating the removable brush head 20 in both the clockwise and count-clockwise directions for installation and removal.

For clarity, FIG. 3 illustrates both stationary portion 22 and movable portion 26 of removable brush head 20 without the plurality of bristles. However, it is to be understood that the plurality of openings 34 of stationary portion 22 and the plurality of openings 36 of the movable portion 26 are each configured to retain a plurality of bristles.

Figure 4A:
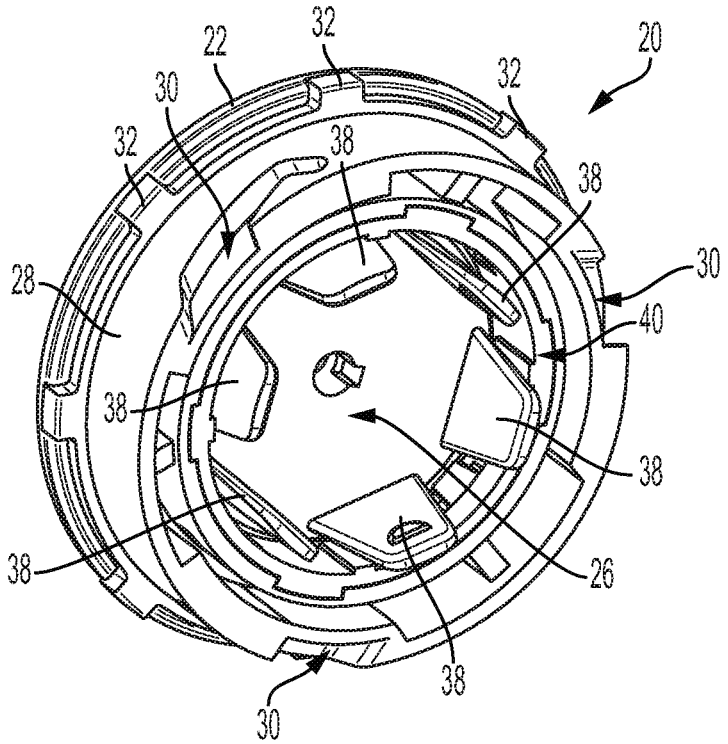
FIG. 4A is a bottom perspective view of the removable brush head of FIG. 1.
Figure 4B:
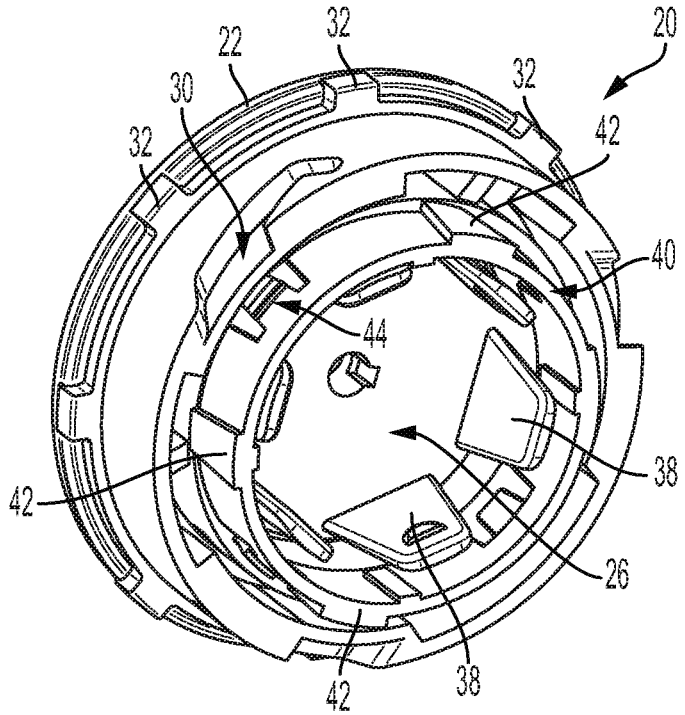
FIG. 4B is a partially exploded view of the removable brush head of FIG. 1.

Referring to FIGS. 4A-4B, bottom perspective views of the removable brush head 20 in accordance with an aspect of the disclosure are shown. As described above, stationary portion 22 annularly surrounds movable portion 26. Movable portion 26 includes a plurality of depending legs 38. While not shown, depending legs 38 are configured to be spaced and shaped so as to operably engage the projections 18*a*-18*n* of the drive hub 16 described above with respect to FIG. 2. In this way, when removable brush head 22 is coupled to hand-held appliance 11, oscillatory and/or rotational motion of the drive hub 16 is imparted on the movable portion 26, providing for a cleansing/scrubbing action of the removable brush head 20.

However, unlike the prior art described above, one or more of the depending legs 38 of movable portion 26 is not also utilized to axially retain movable portion 26 at least partially within stationary portion 22. Rather, movable portion 26 is axially retained within stationary portion 22 via a locking collar 40. As will be described in further detail below, locking collar 40 is configured to prevent substantial axial movement of movable portion 26 with respect to stationary portion 22, while still enabling movable portion 26 to oscillate and/or rotate with respect to stationary portion 22.

As is partially shown in FIG. 4B, locking collar 40 is configured to engage with an interior surface of stationary portion 22. More specifically, locking collar 40 may include a plurality of tongues 42 extending outwardly therefrom, with the plurality of tongues 42 being sized and shaped so as to be slidably received within corresponding grooves formed within the interior surface of the stationary portion 22. Furthermore, the locking collar 40 also includes one or more resilient tabs 44. As will be described in greater detail below, the resilient tabs 44 include outward-projecting bosses, wherein the bosses are configured to engage with corresponding openings formed within the interior surface of the stationary portion 22 so as to further secure the locking collar 40 with respect to the stationary portion 22. During assembly of the removable brush head 20, the locking collar 40 is engaged with the stationary portion 22 after the movable portion 26 has been positioned within a central opening of the stationary portion 22, thereby axially retaining the movable portion 26 within the stationary portion 22.

Figure 5:
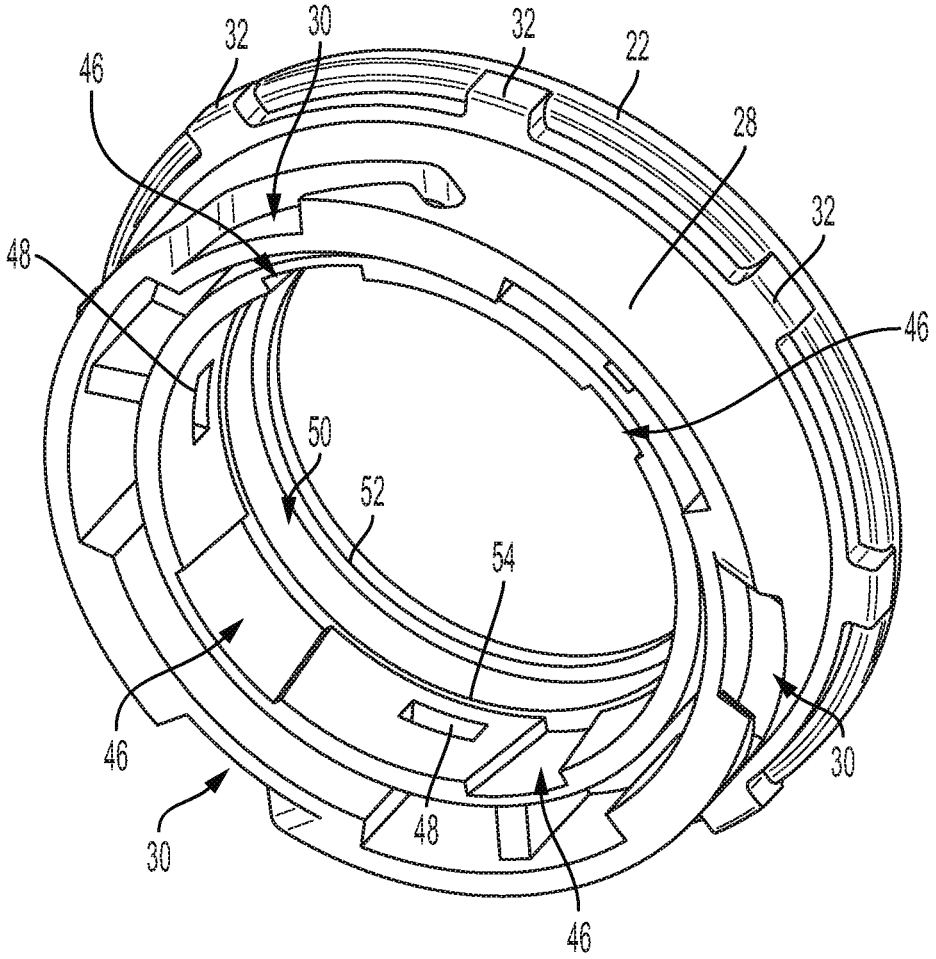
FIG. 5 is a bottom perspective view of a stationary portion of the removable brush head of FIG. 1.

Referring now to FIG. 5, a detailed view of the stationary portion 22 of removable brush head 20 in accordance with an aspect of the disclosure is shown. As described above, an interior surface of stationary portion 22 includes a plurality of grooves 46, with the grooves 46 sized and shaped so as to receive corresponding tongues 42 of the locking collar 40. In FIG. 5, grooves 46 are shown as being varied in width, thereby limiting the orientation of locking collar 40 to that which aligns similarly-sized tongues 42 with corresponding grooves 46. However, it is to be understood that the grooves 46 (and tongues 42) are not limited to such a configuration, and may each be the same size, may having differing depths, etc. In addition to grooves 46, the interior surface of stationary portion 22 also includes a plurality of openings 48. As described above, openings 48 are sized and positioned so as to receive respective outward-projecting bosses on the resilient tabs 44 of locking collar 40, thereby securing locking collar 40 to the interior surface of stationary portion 22.

Figure 6A:
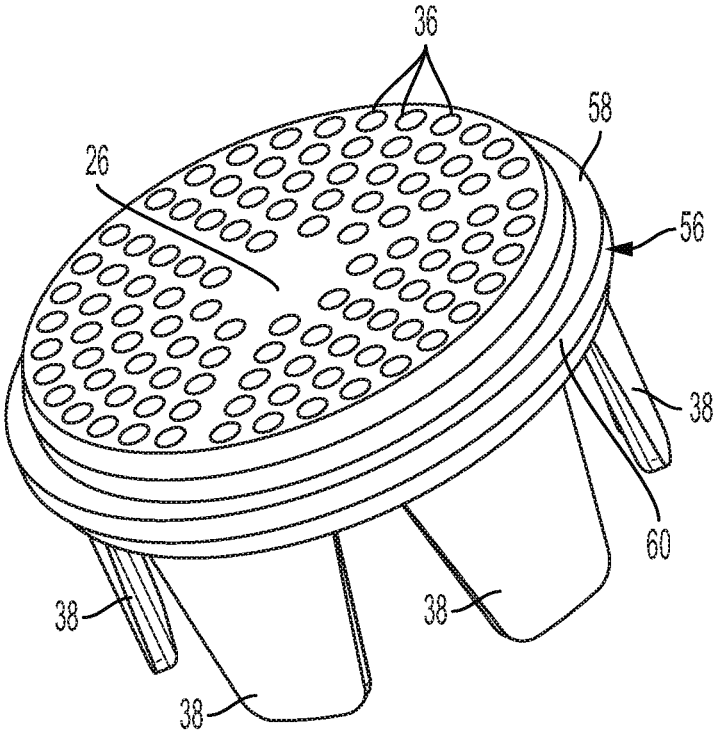
FIG. 6A is a top perspective view of a movable portion of the removable brush head of FIG. 1.
Figure 6B:
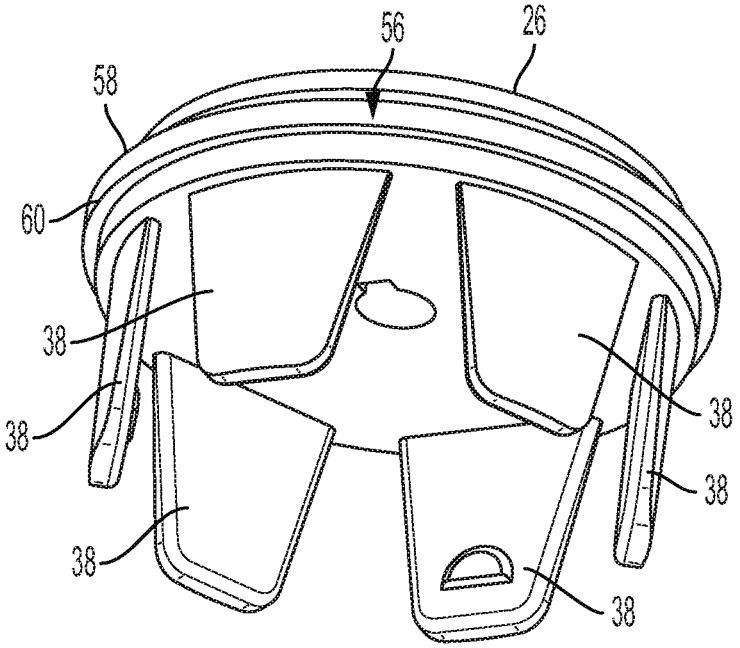
FIG. 6B is a bottom perspective view of the movable portion of the removable brush head of FIG. 1.

Referring still to FIG. 5, stationary portion 22 further includes an annular space 50 formed between an upper restricting face 52 and a lower restricting face 54. Lower restricting face 54 is positioned so as to limit the axial depth of locking collar 40 when locking collar 40 is slidably engaged with stationary portion 22, while upper restricting face 52 is sized so as to restrict outward axial movement of the movable portion 26. That is, the opening formed by upper restricting face 32 is smaller in diameter than some surfaces of movable portion 26, thereby restricting outward axial movement of the movable portion 26 relative to stationary member 22. More specifically, referring to FIGS. 6A-6B, the movable portion 26 includes a ring member 56 annularly extending around the movable portion 26, the ring member 56 having a top bearing surface 58 and a bottom bearing surface 60. The diameter of ring member 56 is larger than the diameter of the opening formed by upper restricting face 52 of stationary portion 22. Thus, when movable portion 26 is positioned within stationary portion 22, the top bearing surface 58 of movable portion 26 contacts the upper restricting face 52.

Figure 7A:
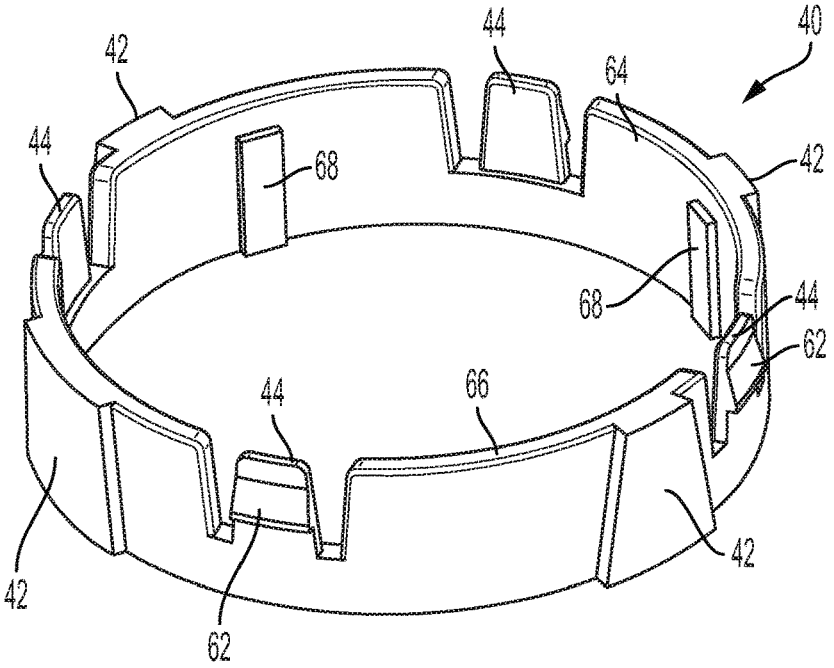
FIG. 7A is a top perspective view of a retaining collar of the removable brush head of FIG. 1.
Figure 7B:
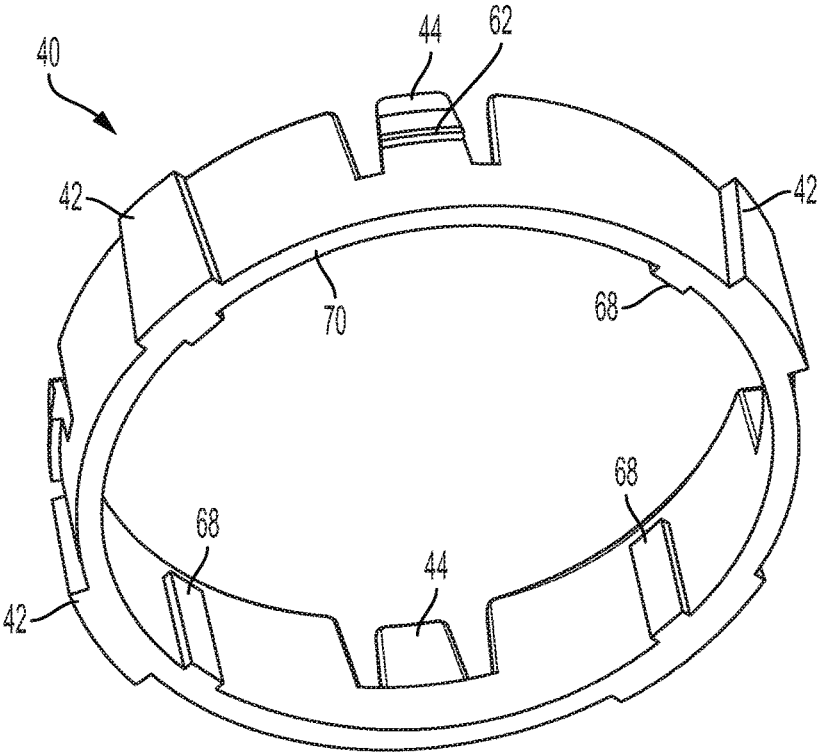
FIG. 7B is a bottom perspective view of the retaining collar of the removable brush head of FIG. 1.
Figure 8:
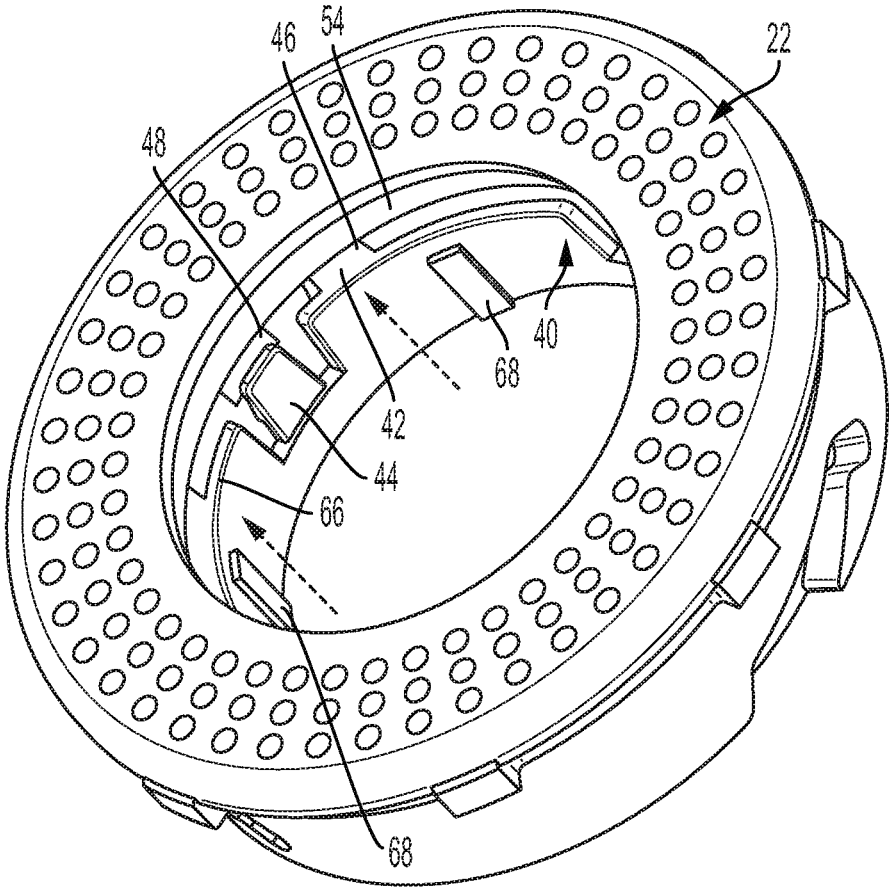
FIG. 8 is a top perspective view of the stationary portion and retaining collar of the removable brush head of FIG. 1.

Likewise, referring to FIGS. 7A-7B and FIG. 8, locking collar 40 includes an upper face 66 which, when locking collar 40 is installed in stationary portion 22, is smaller in diameter than ring member 56. Accordingly, the bottom bearing surface 60 of movable portion 26 contacts this upper face 66 of locking collar 40 after assembly of removable brush head 20. In this way, the upper restricting face 52 of stationary portion 22 and the upper face 66 of locking collar 40 cooperate to substantially restrict axial movement of ring member 56 (and, thus, movable portion 26) in both outward and inward directions, while still enabling oscillatory and/or rotary movement of movable portion 26 relative to stationary portion 22. For clarity, FIG. 8 shows only stationary portion 22 and locking collar 40, with movable portion 26 being omitted to illustrate the engagement between locking collar 40 and stationary portion 22. It is to be understood that, when assembled, movable portion 26 is axially retained relative to stationary portion 22 by locking collar 40.

FIGS. 7A-7B also show the outward-projecting bosses 62 extending from respective resilient members 44 of locking collar 44. As described above, these bosses 62 are sized to engage with the openings 48 formed within stationary portion 22 so as to secure locking collar 44 to stationary portion 22. Resilient members 44 are configured to flex inwardly if subjected to enough axially-directed force, thereby allowing bosses 62 to release from the corresponding openings 48 under such conditions. In this way, locking collar 44 does not necessarily permanently retain movable portion 26 within stationary portion 22, allowing the user (or others) to separate the movable portion 26 and stationary portion 22 using an inward, axially-directed force. However, because this axially-directed force must be inward to achieve such separation, inadvertent separation and/or misalignment of the movable portion 26 relative to the stationary portion 22 during the coupling of the removable brush head 20 to the hand-held appliance 11 is avoided.

Furthermore, FIGS. 7A-7B and FIG. 8 also show a plurality of projections 68 formed on an inner surface of locking collar 40. While upper face 66 of locking collar 40 is preferably used to restrict the axial movement of movable portion 26, these inwardly-directed projections 68 may provide an additional surface capable of restricting axial movement of movable portion 26.

Other advantages of the present disclosure can be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications that are within the scope and spirit of the disclosure as defined in the claims.

The invention claimed is:

1. A removable brush head for a personal grooming device, the brush head comprising:

a stationary portion, wherein the stationary portion includes a plurality of outwardly-extending brush bristles;

a movable portion positioned within the stationary portion, wherein the movable portion:

is configured to at least partially rotate relative to the stationary portion, includes a plurality of outwardly-extending brush bristles, and includes a plurality of depending legs that are configured to operably engage a drive hub of a personal grooming device, wherein none of the plurality of depending legs are configured to engage the stationary portion.

2. The removable brush head of claim 1 further comprising a locking collar that is slidably couplable to the stationary portion so as to axially retain the movable portion within the stationary portion while allowing the movable portion to at least partially rotate relative to the stationary portion, wherein the locking collar is slidably couplable to an inner surface of the stationary portion.

3. The removable brush head of claim 2, wherein the inner surface of the stationary portion comprises a plurality of grooves and an outer surface of the locking collar comprises a plurality of tongues, further wherein the plurality of tongues of the locking collar are configured to slidably engage with the plurality of grooves of the stationary portion.

4. The removable brush head of claim 3, wherein one or more of the plurality of grooves is sized differently than another one or more of the plurality of grooves, and further wherein one or more of the plurality of tongues is sized differently than another one or more of the plurality of tongues.

5. The removable brush head of claim 2, wherein the inner surface of the stationary portion further comprises a plurality of openings.

6. The removable brush head of claim 5, wherein the locking collar further comprises a plurality of resilient tabs, wherein each resilient tab comprises a boss extending outwardly therefrom, and further wherein each boss is configured to engage with a respective one of the plurality of openings.

7. The removable brush head of claim 6, wherein the plurality of resilient tabs are inwardly deflectable so as to enable the respective bosses to be disengaged from the respective openings.

8. The removable brush head of claim 1, wherein the movable portion further comprises a ring member annularly extending around the movable portion.

9. The removable brush head of claim 8, wherein the ring member comprises a top bearing surface and a bottom bearing surface.

10. The removable brush head of claim 8, wherein the ring member of the movable portion is positioned to restrict axially movement of the movable portion relative to the stationary portion.

11. The removable brush head of claim 1, wherein the stationary member further comprises a rim, and further wherein an outer surface of the rim comprises a plurality of slots formed therein.

12. The removable brush head of claim 1, wherein the stationary member further comprises a plurality of grip protrusions.

13. A personal grooming device comprising:

a motor;

a drive hub operably coupled to the motor, wherein the motor is configured to impart an oscillatory motion, a rotary motion or both on the drive hub; and a removable brush head that comprises:

a stationary portion that includes a plurality of outwardly-extending brush bristles;

a movable portion positioned within the stationary portion, wherein the movable portion:

is configured to at least partially rotate relative to the stationary portion, includes a plurality of outwardly-extending brush bristles, and includes a plurality of depending legs that are configured to:

operably engage the drive hub, and impart the at least one of the oscillatory motion and the rotary motion of the drive hub on the movable portion, wherein none of the plurality of depending legs are configured to engage the stationary portion.

14. The personal grooming device of claim 13, wherein:

the drive hub further comprises a plurality of projections; and wherein the plurality of depending legs are configured to engage with the drive hub via the plurality of projections.

15. The personal grooming device of claim 13, further comprising a plurality of pins, and wherein the stationary member of the removable brush head further comprises a plurality of slots formed on an outer surface of a rim of the stationary member, wherein each of the plurality of pins is configured to engage with a respective one of the plurality of slots.

16. The personal grooming device of claim 13, wherein:

the removable brush head further comprises a locking collar that is slidably couplable to the stationary portion so as to axially retain the movable portion within the stationary portion while allowing the movable portion to at least partially rotate relative to the stationary portion; and an inner surface of the stationary portion of the removable brush head comprises a plurality of grooves and an outer surface of the locking collar of the removable brush head comprises a plurality of tongues, further wherein the plurality of tongues of the locking collar are configured to slidably engage with the plurality of grooves of the stationary portion.

17. The personal grooming device of claim 16, wherein the inner surface of the stationary portion further comprises a plurality of openings and the locking collar further comprises a plurality of resilient tabs, wherein each resilient tab comprises a boss extending outwardly therefrom, and further wherein each boss is configured to engage with a respective one of the plurality of openings.

18. The personal grooming device of claim 13, wherein:

the movable portion of the removable brush head further comprises a ring member annularly extending around the movable portion; and the ring member of the movable portion is positioned to restrict axial movement of the movable portion relative to the stationary portion.

19. The personal grooming device of claim 13, wherein the stationary member of the removable brush head further comprises a plurality of grip protrusions that are configured to provide a gripping surface for a user to rotatably couple or decouple the removable brush head from the hand-held appliance.

* * * * *